United States Patent [19]

Finsterwalder

[11] 4,274,356

[45] Jun. 23, 1981

[54] SEMI-SUBMERSIBLE FLOATING STRUCTURE

[75] Inventor: Klemens Finsterwalder, Mörlbach, Fed. Rep. of Germany

[73] Assignee: Dyckerhoff & Widmann Aktiengesellschaft, Munich, Fed. Rep. of Germany

[21] Appl. No.: 923,986

[22] Filed: Jul. 12, 1978

[30] Foreign Application Priority Data

Jul. 14, 1977 [DE] Fed. Rep. of Germany ..... 2731788

[51] Int. Cl.[3] ..... B63B 35/44

[52] U.S. Cl. ..... 114/265

[58] Field of Search ..... 114/264, 265, 266, 256; 9/8 P; 405/195, 207, 208

[56] References Cited

U.S. PATENT DOCUMENTS

| | | | |
|---|---|---|---|
| 2,667,038 | 1/1954 | Bayley | 405/207 |
| 2,889,795 | 6/1959 | Parks | 114/265 |
| 3,397,545 | 8/1968 | Leavitt | 114/265 |
| 3,507,239 | 4/1970 | Wipkink et al. | 9/8 P |
| 3,592,155 | 7/1971 | Rosenberg | 114/265 |
| 3,605,669 | 9/1971 | Yu | 114/265 |

*Primary Examiner*—Trygve M. Blix
*Assistant Examiner*—Jesus D. Sotelo

[57] ABSTRACT

A semi-submersible floating structure includes a horizontal platform with a symmetrical arrangement of buoyant bodies extending vertically downwardly from the platform. The buoyant bodies consist of a tubular column secured by a bending-resistant connection to the platform with a closed container secured to and extending downwardly from the lower end of the tubular column. The horizontal cross-sectional area of the closed container is for most of its vertical height greater than the transverse cross-sectional area of the tubular column. At least the lower portion of the closed container has a curvilinear surface. An annular wall extends around and is spaced radially outwardly from each of the closed containers and the wall, in combination with the enclosed container, forms an annular chamber therebetween open at the bottom and closed at the top. The platform and the buoyant bodies are formed of reinforced concrete or prestressed concrete.

7 Claims, 5 Drawing Figures

SEMI-SUBMERSIBLE FLOATING STRUCTURE

SUMMARY OF THE INVENTION

The invention is directed to a semi-submersible floating structure including storage space for liquids, such as crude oil, liquid gas or the like, and consists of a platform and a plurality of buoyant bodies connected to and extending downwardly from the platform.

A known floating structure of this type which includes storage containers consists of a plurality of bottle-shaped members formed of reinforced concrete and connected to square plates both in the region of their narrow necks and of their lower ends, not U.S. Pat. No. 3,592,155. These plates have continuous channels along their sides through which tendons can be inserted for connecting several plates together with spacers located between the plates. The bottle-shaped structures can be divided by floors into various rooms for accommodating personnel, for the storage of petroleum products and, at least in the lowermost room, for use as a ballast tank.

The characteristic feature of a semi-submersible floating structure is that its buoyant bodies extend downwardly to a location below the water surface where wave motion causes no significant influence. Further, the platform portion of the structure is supported by slender columns which present a relatively small surface against which the wave forces can act. As a rule, such a semi-submersible floating structure is stabilized by its weight, that is, the floating stability is effected by the weight with the center of gravity being located below the center of buoyancy. Such a semi-submersible floating structure has buoyant bodies with rather large dimensions, a ballast system with appropriate counterweights and a very deep draft. As a result, the construction of such floating structures is very expensive and cumbersome. Because of its deep draft, such a structure cannot be constructed at a dock but must be assembled from individual elements at a deep water location, as is the case for known semi-submersible floating structures. The individual elements must be towed to the place of assembly in a position different from their assembled positions.

As distinguished from the semi-submersible floating structures, there are so-called surface follower structures, that is, a structure which floats on the water surface in a manner similar to that of a ship. If such a surface follower structure has the shape of a ship's body or a pontoon, it has a shallow draft, it required no ballast space and counterweights and, therefore, can be constructed more economically than a semi-submersible floating structure. Such surface follower structures, however, have a less favorable behavior in response to water movement, since they are subjected to wave movements and presents a large area against which the waves can act.

Therefore, a primary object of the present invention is to provide a floating structure affording storage space and including a platform which has the advantageous behavior of a semi-submersible floating structure, but can be constructed in a simpler and less expensive manner than the known semi-submersible floating structures.

In accordance with the present invention, the buoyant bodies are formed by closed containers which can act as storage tanks and have the shape of a body of rotation formed of either reinforced concrete or prestressed concrete. The generatrix of the body of rotation is at least partially curved and the closed containers are secured to the platform by a bending resistant connection. Further, the platform is constructed as a bending-resistant member and, preferably, is in the form of a plate made of reinforced concrete or prestressed concrete. The buoyant bodies include tubular columns extending upwardly from the closed containers and connected directly to the platform. These columns afford hollow spaces especially useful for containing ballast water. Preferably, the buoyant bodies are arranged radially outwardly from the center of the platform in a symmetrical pattern at the outer periphery which may be polygonal but, preferably, is circular.

Each or only selected ones of the closed containers of the buoyant bodies can be surrounded by an annular vertical wall connected to the upper portion of the closed container and extending downwardly at least to its bottom end. The annular wall is spaced outwardly from the closed container and forms therebetween a chamber open at its bottom. This chamber can be divided into a plurality of separate subchambers by radially extending partition walls.

Inherently stable semi-submersible floating structures are created in accordance with the present invention with the floating stability of such structures being effected by their shape. The center of gravity of the floating structure is located between the metacenter and the center of buoyancy, affording an intermediate solution, so to speak, between a semi-submersible floating structure which is stable by weight and a surface follower. By utilizing the hollow spaces within the tubular columns as ballast tanks, additional structure for creating such ballast spaces is unnecessary and, in addition, a favorable floating behavior is gained. In such an arrangement, the ballast tanks are located above the storage tanks. Moveover, there is the advantageous result that the individual buoyant bodies are each inherently stable and, due to its shallow draft, can be towed with its tubular column in a vertical floating position and can be assembled to form the floating structure by pouring a platform over the tubular columns.

The favorable floating qualities of the semi-submersible floating structure embodying the present invention are enhanced in that the water contained in the open bottom chambers is retained during movement of the structure and, therefore, provides an integrated part of the inertia forces afforded by the mass of the floating structure. Due to this arrangement, the oscillation behavior of the structure is influenced in such a manner that the type of wave action experienced in practice does not lead to any significant agitation of the structure. Furthermore, the actual frequency of the structure can be adjusted in a simple manner to the wave spectrum to be expected, that is, by providing open bottom chambers of appropriate depth. The walls forming the chambers afford an excellent damping effect, not only with regard to rolling and pitching motion, but also with regard to heaving motion.

Apart from the favorable influence on the oscillation behavior of the structure, the chambers laterally enclosing the buoyant bodies also result in advantages in its construction. While the chambers are filled with water during operation, during construction they can be filled with air aiding in the buoyancy of the arrangement. Accordingly, further advantages are gained due to the significantly reduced draft of the structure, for instance, the depth of the dock at which it is built can be reduced.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
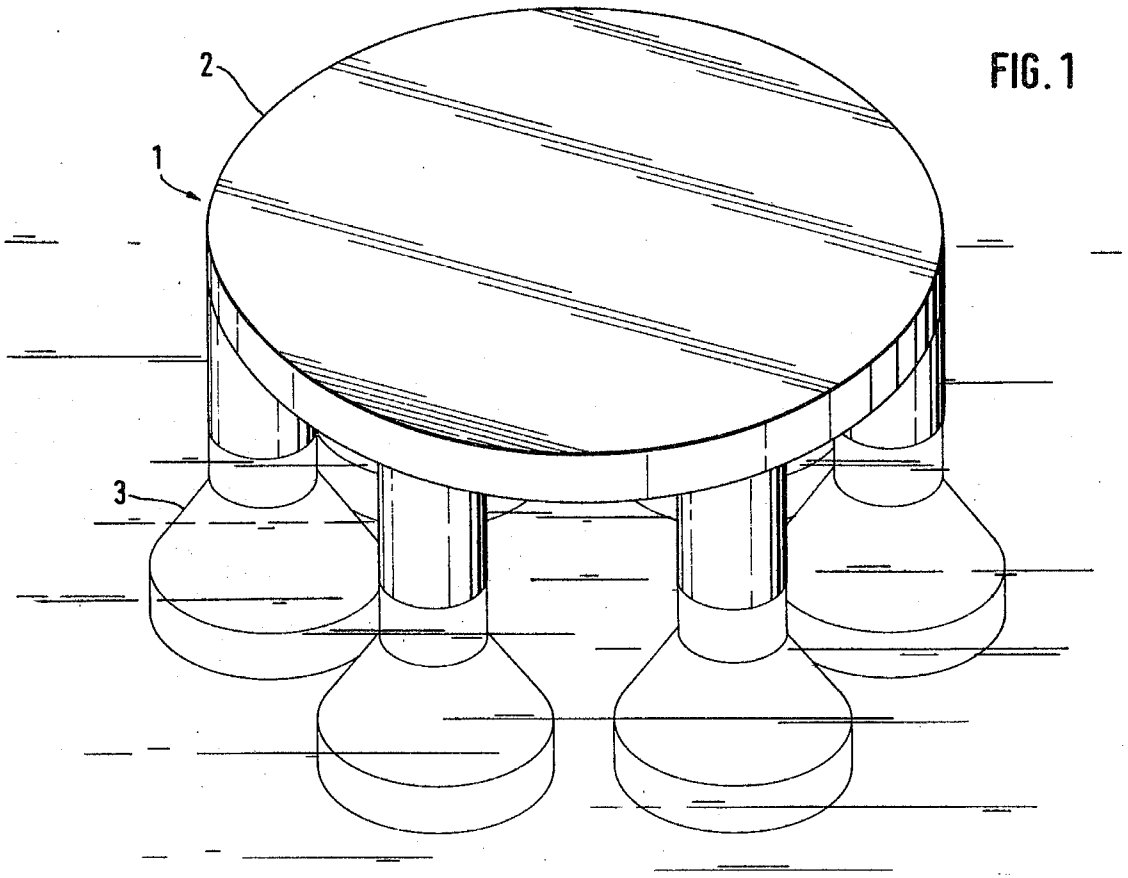
FIG. 1 is a perspective view of a semi-submersible floating structure embodying the present invention.
Figure 2:
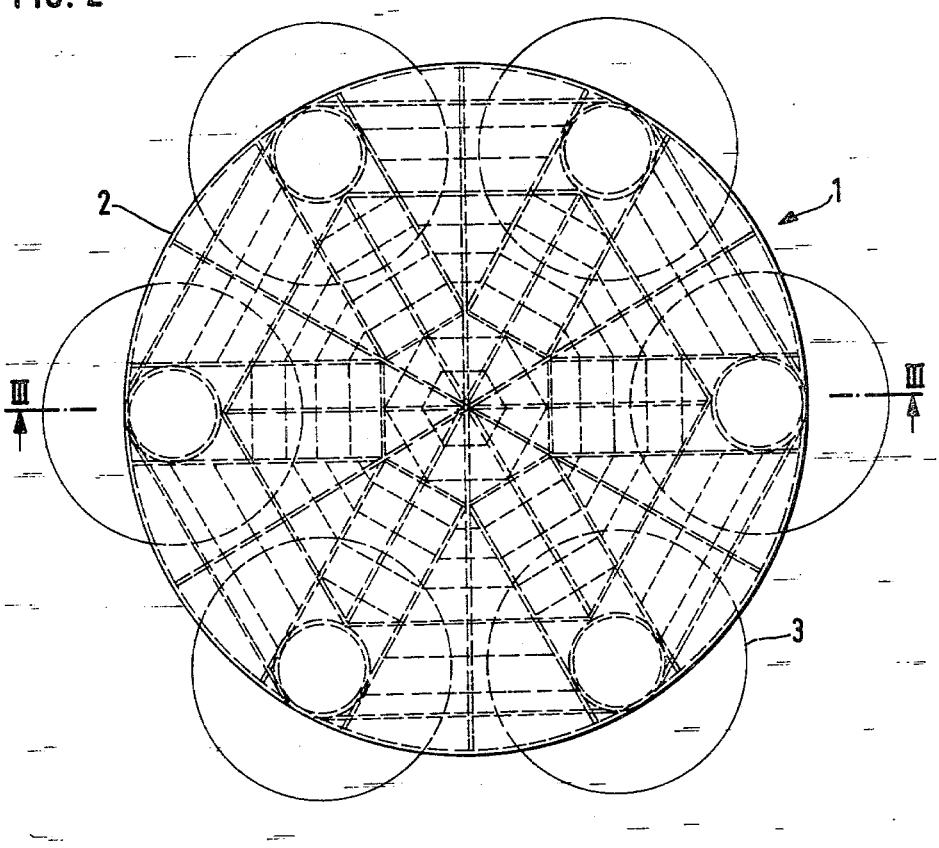
FIG. 2 is a top view of the floating structure shown in FIG. 1.
Figure 3:
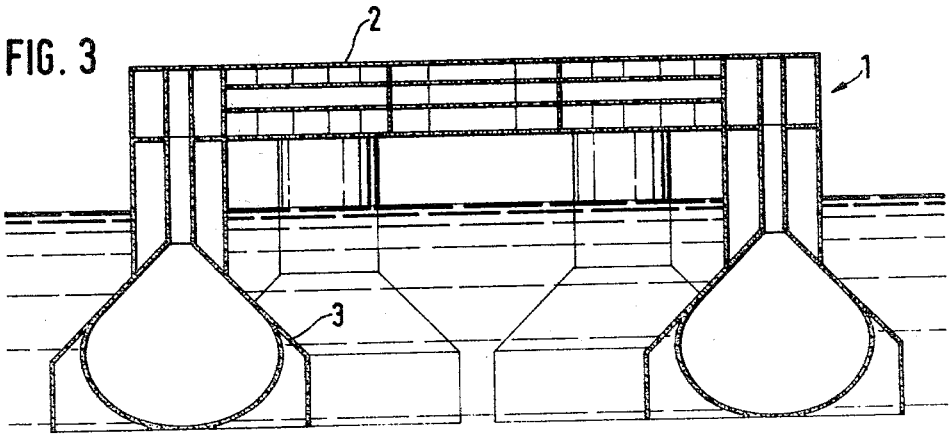
FIG. 3 is a sectional view taken along a line III—III in FIG. 2.

In the drawing a semi-submersible floating structure 1 is shown consisting of a generally horizontal platform 2 which is resistant to bending with a plurality of buoyant bodies 3 extending vertically downwardly from the platform. The platform can be constructed in any desired manner. As illustrated, the circumferential periphery of the platform is circular though it could be polygonal. In the illustrated embodiment, the platform 2 consists of a plate of prestressed concrete stiffened by ribs. The platform may, however, be constructed from reinforced concrete.

Figure 4:
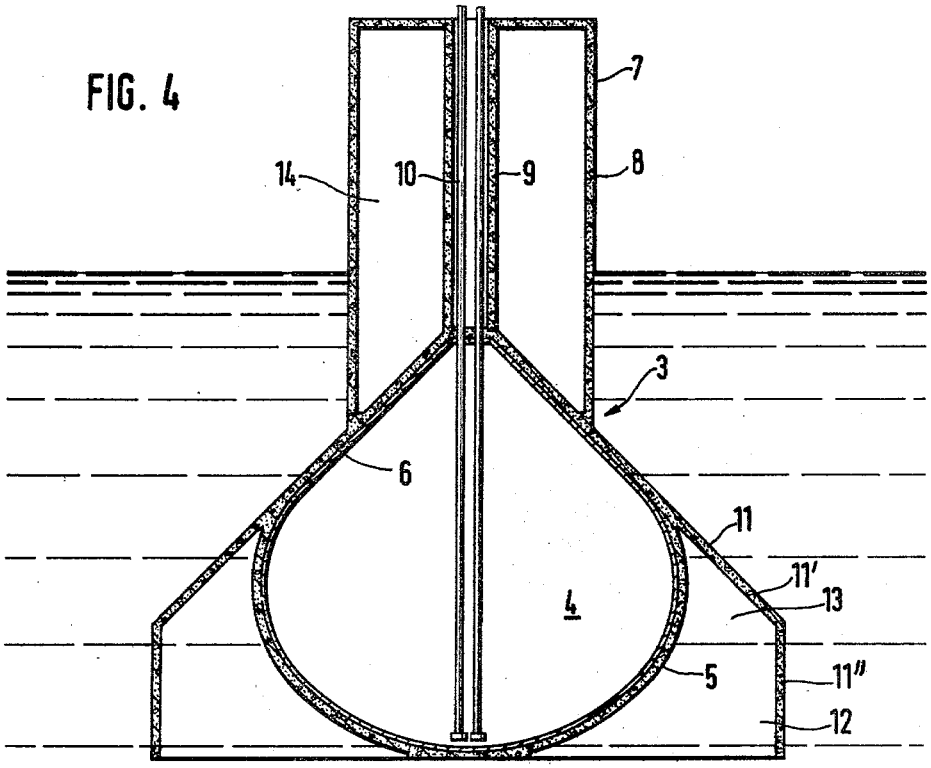
FIG. 4 is an enlarged sectional view through one of the buoyant bodies of the floating structure.
Figure 5:
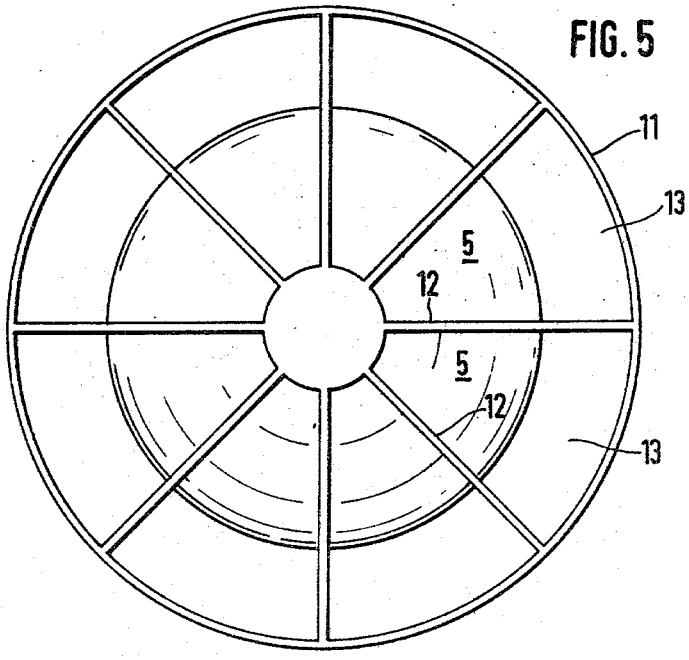
FIG. 5 is a bottom view of the buoyant body illustrated in FIG. 4.

In the illustrated embodiment six buoyant bodies 3 formed of reinforced concrete or prestressed concrete are connected to the platform in a bending-resistant manner. Each of the buoyant bodies 3 consists of a lower closed container portion 4 constructed as a body of rotation about a vertical axis with the lower portion of the generatrix body being elliptically curved and the upper portion 6 being rectilinear. The rectilinear upper portion 6 extends radially outwardly and downwardly from the top end of the container to a horizontal plane intermediate the top and bottom ends at which plane the generatrix changes over into an elliptically curved line terminating at the bottom end of the container. Secured to and extending upwardly from a location adjacent the upper end of the container 4, is a tubular column 7 having a cylindrically shaped outer wall 8 which extends upwardly into the platform 2. A cylindrical tube 9 is located radially inwardly from the inner surface of the tubular column so that a hollow annular space is provided about the tube 9 closed at its lower end by the container 4 and at its upper end by the platform 2. Pipe lines 10 extend vertically downwardly through the tube 9 into the storage tank or space formed within the container 4, these pipe lines can be used for filling and emptying the storage tank, note FIG. 4. The lower end of the tube 9 intersects the container at its top end while the tubular column 7 intersects the container in a horizontal plane spaced downwardly below the top end.

Each of the containers 4 of the buoyant bodies 3 are surrounded by an annular wall 11. At its upper end, the annular wall 11 has frusto-conical shape 11' extending radially outwardly and downwardly from the rectilinear portion 6 of the outer surface of the container. At a location spaced radially outwardly and downwardly from the intersection of the rectilinear and curvilinear surfaces of the containers, the wall changes from the frusto-conical shape 11' to a cylindrically shaped vertical portion 11'' and extends downwardly to a horizontal plane including the bottom end of the container 4. An annular space or chamber is provided between the outer surface 5 of the container and the inner surfaces of the annular wall 11 and, as mentioned, this space is open at the lower end of the annular wall. A plurality of partition walls 12 extending radially inwardly from the inner surface of the annular wall 11 to the outer surface 5 of the container, divide the open space therebetween into a number of individual subchambers 13.

Valve-like openings, not shown, are provided so that air trapped within the subchambers 13 during construction can escape and permit water to fill the subchambers. These openings are closed when the illustrated unit is used as a semi-submersible floating structure.

The individual buoyant bodies 3 can be constructed at a dock or in relatively shallow water. Air trapped in the subchambers 13 results in additional buoyancy. The individual buoyant bodies 3 have such a favorable floating behavior that they can be towed with little draft in a vertical position to a location where they are lowered to the required floating depth and where a platform 2, which is resistant to bending, is formed over and connected to the upper ends of the buoyant bodies. When used as a semi-submersible floating structure, an appropriate amount of ballast water is pumped into the spaces 14 located within the tubular columns 7 and around the outer surface of the tubes 9. When wave movement occurs, the water mass enclosed in the subchambers 13 is held therein, accordingly, the water mass fully enters into the inertia forces resulting from the mass of the floating structure. Simultaneously, any movement of the individual parts of the enclosed water mass around the individual buoyant bodies is restricted by the annular wall 11 and the partition walls 12. When movements occur, particularly at the bottom edges of the annular wall 11 and the partition walls 12, vortices are created which effectively dampen such movements. The closed spaces within the containers 4 of the buoyant bodies 3 can be used in any desired manner for the storage of liquids, such as crude oil, liquified natural gas or the like. If necessary, the inner surfaces defining these spaces can be provided with appropriate thermal and/other types of insulation. The platform 2 can be used as a floating island, as a drilling platform, or as a liquifying plant for natural gas or the like.

While specific embodiments of the invention have been shown and described in detail to illustrate the application of the inventive principles, it will be understood that the invention may be embodied otherwise without departing from such principles.

What is claimed is:

1. A semi-submersible floating structure including a storage space for liquids, such as crude oil, liquid gas and the like, comprising a generally horizontally arranged platform formed of concrete, a plurality of laterally spaced buoyant bodies secured to and extending downwardly from said platform, each said buoyant body comprising an upper part having an upper end and a lower end spaced downwardly from the upper end with the upper end secured to said platform and with the upper part extending downwardly from said platform and a lower part secured to the lower end of said upper part and extending downwardly therefrom, said upper part comprising a tubular column, wherein the improvement comprises that said lower part comprises a closed container formed of one of reinforced concrete and prestressed concrete and having a vertically extending axis with the outer surface thereof shaped as a generatrix of a body of rotation with at least a part thereof being curved, said tubular column secured to said platform by a bending-resistant connection, said platform is a plate shaped member formed of one of reinforced concrete and prestressed concrete and said tubular column being closed off at the upper and lower ends thereof and forming therein a hollow space for use as a tank, such as for ballast water, said lower part has a top end and a bottom end spaced apart in the vertical direction, the open horizontal cross-sectional area within said lower part being greater for at least a major portion of the height thereof than the open cross-sectional area within said tubular column, the generatrix forming the outer surface of said lower part extends rectilinearly outwardly ad downwardly relative to the axis of said lower part to a horizontal plane intermediate the top and bottom ends and continues from the intermediate plane along a curvilinear path to the bottom end of said lower part with the curvilinear portion of the generatrix extending inwardly to the bottom end, a vertically extending annular wall laterally encloses at least some of said buoyant bodies, the upper end of said annular wall being connected to the rectilinear portion of the outer surface of the said lower part and the lower end of said annular wall extending downwardly at least to a horizontal plane including the bottom end of said lower part, said annular wall being spaced radially outwardly from said lower part below the connection of the upper end of said annular wall to said lower part and the inner surface of said annular wall and the outer surface of said lower part forming an annular chamber therebetween closed at the upper end by the connection of said annular wall to said lower part and open at the lower end thereof.

2. A semi-submersible floating structure, as set forth in claim 1, wherein a plurality of partition walls extend radially outwardly from the outer surface of said lower part to the inner surface of said annular wall and divide the annular chamber therebetween into a plurality of subchambers.

3. A semi-submersible floating structure, as set forth in claim 1, wherein a vertically extending cylindrical tube is located within at least certain of said tubular columns and extends downwardly from said platform to the top end of said lower part and forms a passageway through said tubular column for piping connected to said lower part for filling and emptying the closed container formed therein.

4. A semi-submersible floating structure, as set forth in claim 1, wherein said annular wall comprises a frusto-conically shaped upper part connected to the rectilinear portion of the outer surface of said lower part and projects radially outwardly and downwardly therefrom to a horizontal plane located between the top and bottom ends of said lower part and a cylindrically shaped lower part extends downwardly from the lower end of said frusto-conically shaped upper part.

5. A semi-submersible floating structure, as set forth in claim 1, wherein said buoyant bodies being arranged radially outwardly from and symmetrically about the center of said platform.

6. A semi-submersible floating structure, as set forth in claim 5, wherein said platform having a circular radially outer circumference.

7. A semi-submersible floating structure, as set forth in claim 6, wherein the radially outer surface of said tubular columns being in substantial alignment with the circular outer circumferential surface of said platform.

* * * * *